US008596478B2

(12) United States Patent
Gadzic et al.

(10) Patent No.: US 8,596,478 B2
(45) Date of Patent: Dec. 3, 2013

(54) CAP ASSEMBLY WITH ATTACHED FLEXIBLE LINER FOR USE WITH A CONTAINER TO HOLD CONTENTS THEREIN

(76) Inventors: Andrew Gadzic, Ridgewood, NY (US); Samuel P. Laufer, New York, NY (US); William S. Laufer, Philadelphia, PA (US); Jack Laufer, New York, NY (US); Leopold S. Laufer, Yorktown Heights, NY (US)

( * ) Notice: Subject to any disclaimer, the term of this patent is extended or adjusted under 35 U.S.C. 154(b) by 1426 days.

(21) Appl. No.: 12/134,742

(22) Filed: Jun. 6, 2008

(65) Prior Publication Data

US 2009/0008356 A1 Jan. 8, 2009

Related U.S. Application Data

(60) Provisional application No. 60/942,574, filed on Jun. 7, 2007.

(51) Int. Cl.
*B65D 39/00* (2006.01)

(52) U.S. Cl.
USPC ..... 215/355; 215/367.1; 220/373; 220/255; 141/320; 141/329

(58) Field of Classification Search
USPC ..... 215/329, 310, 311, 355, 364, 349; 220/367.1, 37, 373, 255, 254.1; 141/319, 320, 329, 10, 313, 65; 222/107, 482, 483, 488, 491, 494, 222/212–215; 383/901; 426/106
See application file for complete search history.

(56) References Cited

U.S. PATENT DOCUMENTS

| | | | | | |
|---|---|---|---|---|---|
| 2,855,933 | A | * | 10/1958 | Erikson | 604/415 |
| 3,163,544 | A | * | 12/1964 | Valyi | 426/112 |
| RE26,488 | E | * | 11/1968 | Bull | 222/107 |
| 3,414,165 | A | * | 12/1968 | Goodenow | 222/82 |
| 3,782,610 | A | | 1/1974 | Gilbert | |
| 3,851,781 | A | | 12/1974 | Marco | |
| 3,907,169 | A | | 9/1975 | Gortz et al. | |
| RE31,135 | E | | 2/1983 | Winchell et al. | |
| 4,883,148 | A | | 11/1989 | Welch | |

(Continued)

FOREIGN PATENT DOCUMENTS

FR 2676210 11/1992

OTHER PUBLICATIONS

International Search Report and Written Opinion of the International Searching Authority for PCT/US2008/66121 dated Oct. 27, 2008.

*Primary Examiner* — J. Gregory Pickett
*Assistant Examiner* — Raven Collins
(74) *Attorney, Agent, or Firm* — Leason Ellis LLP

(57) ABSTRACT

A closure for a container for sealing the contents of the container includes a cap assembly having a first portion that is insertable into a dispensing opening formed in the container and a second portion that is rotatable relative to the first portion. The cap is positionable between at least a dispensing position in which the contents of the container can be dispensed through the cap assembly and a closed position in which the contents are sealed in the container from atmospheric conditions. The closure also includes a rollable, flexible liner for receiving and holding the contents, the liner being coupled to the cap assembly and in fluid communication therewith so that the liner can initially receive the contents and later dispense the contents through the cap assembly.

21 Claims, 22 Drawing Sheets

(56) References Cited

U.S. PATENT DOCUMENTS

| | | | | |
|---|---|---|---|---|
| 5,108,007 | A | 4/1992 | Smith | |
| 5,265,767 | A | 11/1993 | Gustafson | |
| 5,615,803 | A | 4/1997 | Hatakeyama et al. | |
| 5,673,809 | A | 10/1997 | Ohmi et al. | |
| 5,792,425 | A | 8/1998 | Clark et al. | |
| 6,003,711 | A | 12/1999 | Bilewitz | |
| 6,056,730 | A * | 5/2000 | Greter | 604/319 |
| 6,090,029 | A | 7/2000 | LaFleur | |
| 6,375,040 | B1 * | 4/2002 | Allanson et al. | 222/105 |
| 6,620,141 | B2 | 9/2003 | Levell | |
| 6,868,990 | B2 | 3/2005 | Cater et al. | |
| 6,997,399 | B2 * | 2/2006 | Lacy | 239/373 |
| 2006/0011630 | A1 | 1/2006 | Mulle | |
| 2006/0037927 | A1 | 2/2006 | Williams et al. | |
| 2006/0283523 | A1 | 12/2006 | Gadzic et al. | |

* cited by examiner

CAP ASSEMBLY WITH ATTACHED FLEXIBLE LINER FOR USE WITH A CONTAINER TO HOLD CONTENTS THEREIN

CROSS-REFERENCE TO RELATED APPLICATION

The present application claims the benefit of U.S. patent application Ser. No. 60/942,574, filed Jun. 7, 2007, which is hereby incorporated by reference in its entirety.

TECHNICAL FIELD

The present invention relates generally to containers and storage receptacles and more particularly, to a cap and liner system that includes a valve assembly for preventing atmospheric air from contacting the stored contents.

BACKGROUND

Many liquids, such as alcoholic beverages, fruit juices and dairy products rapidly deteriorate when exposed to atmospheric conditions and more specifically, when exposed to oxygen following the initial opening of the container. One particular product that is particularly susceptible to deterioration due to rapid oxidation is wine due to the basic chemistry of wine. For most wines, winemakers go to great lengths to protect them from seeing too much oxygen. Deciding just how much is too much, both during winemaking and for bottled wine, is at the heart of many of the wine world's most heated current debates. The precise role of oxygen in wine development and ageing is still being unraveled. To prevent oxidation, bottling practices are followed by most commercial wineries that minimize the exposure to oxygen. This precaution is further complicated by the use of closures, such as natural cork, that are susceptible to oxygen intrusion or other contaminants. Despite all the measures taken before and during the filling process, when the container is subsequently opened, oxygen intrusion immediately occurs and the process of oxidation and spoilage begins resulting in the remaining product rapidly degrades and spoils.

While some wine shortcomings are more difficult to experience, oxidation is much easier to experience. Simply take a bottle of wine, pour a couple of glasses and enjoy and then recork the bottle and leave it on your counter for a few days. After a few days, pour another glass and compare your impressions of this glass of wine, which will by now be partly oxidized, with your previous experience of the wine from the same bottle. No doubt, your experience will be less than satisfactory. With oxidation, it's not so much what it contributes as what it takes away. The dominant feature one experiences is one of flatness. This is because exposure to oxygen has taken out some of the volatile chemicals that are an important part of wine aroma. However there is also a contribution from chemicals formed by the oxidation process, the most important of which is acetaldehyde, and in addition, the fruit in oxidized red wines begins to take on a caramel-like quality, and oxidized whites wines become heavy and dull. Moreover, the palate of oxidized red wines also changes since the wines tend to take on a dry, slightly bitter characteristic. In addition, oxidation causes color changes in the wines.

Because the interaction of oxygen and wine is potentially damaging, wine needs to be protected both during the bottling process and after opening the bottle if the entire bottle is not consumed during one sitting. There have been a number of attempts to minimize the effects of oxidation on the liquid that is within the container; however, each of these attempts has its own shortcomings.

SUMMARY OF THE INVENTION

In one embodiment, a closure for a container for sealing the contents of the container includes a cap assembly having a first portion that is insertable into a dispensing opening formed in the container and a second portion that is rotatable relative to the first portion. The cap is positionable between at least a dispensing position in which the contents of the container can be dispensed through the cap assembly and a closed position in which the contents are sealed in the container from atmospheric conditions. The closure also includes a rollable, flexible liner for receiving and holding the contents, the liner being coupled to the cap assembly and in fluid communication therewith so that the liner can initially receive the contents and later dispense the contents through the cap assembly.

According to another embodiment, a closure that seals the inside of the container from atmospheric conditions includes a first seal member that is inserted into a dispensing opening formed in the container. The first seal member has a dispensing channel formed therein and a one-way valve member disposed in the dispensing channel for sealing the inside of the container when it is in a closed position. The closure also includes a second seal member that is rotatably coupled to the first seal member. The second seal member has an opening formed therein and is positionable between an open position, where the underlying valve member is exposed through the opening in the second seal member, and a closed position in which the opening is offset from the valve member and the dispensing channel.

A closure for scaling the inside of the container from atmospheric conditions includes a cap assembly having a body that is insertable into a dispensing opening formed in the container and a cap that is rotatable relative to the first portion. The body includes a base section and a stem extending outwardly therefrom for reception into the container opening. The stem and base section includes at least a vent channel for delivering air into the bottle and a first main channel and a second main channel separate from the first main channel. The cap assembly includes a cap member that is rotatably coupled to the body and includes at least one opening. The closure also includes a first valve assembly that is operatively connected to the first main channel and includes a first one way valve and a second valve assembly that is operatively connected to the second main channel and includes a second one way valve. The closure includes a first rollable, flexible liner for receiving and holding first contents, the first liner being coupled to the first main channel; and a second rollable, flexible liner for receiving and holding second contents, the second liner being coupled to the second main channel. The cap is positionable between at least a first dispensing position in which the opening in the cap is in registration with the first main channel and the first contents of the container can be dispensed through the cap assembly. The cap can be positioned in a second dispensing position in which the opening in the cap is in registration with the second main channel and the second contents of the container can be dispensed through the cap assembly. In the first dispensing position, the second main channel is sealed closed and in the second dispensing position, the first main channel is sealed closed.

BRIEF DESCRIPTION OF THE DRAWING FIGURES

The foregoing and other features of the present invention will be more readily apparent from the following detailed description and drawings of illustrative embodiments of the invention in which.

DETAILED DESCRIPTION OF PREFERRED EMBODIMENTS

Figure 10:
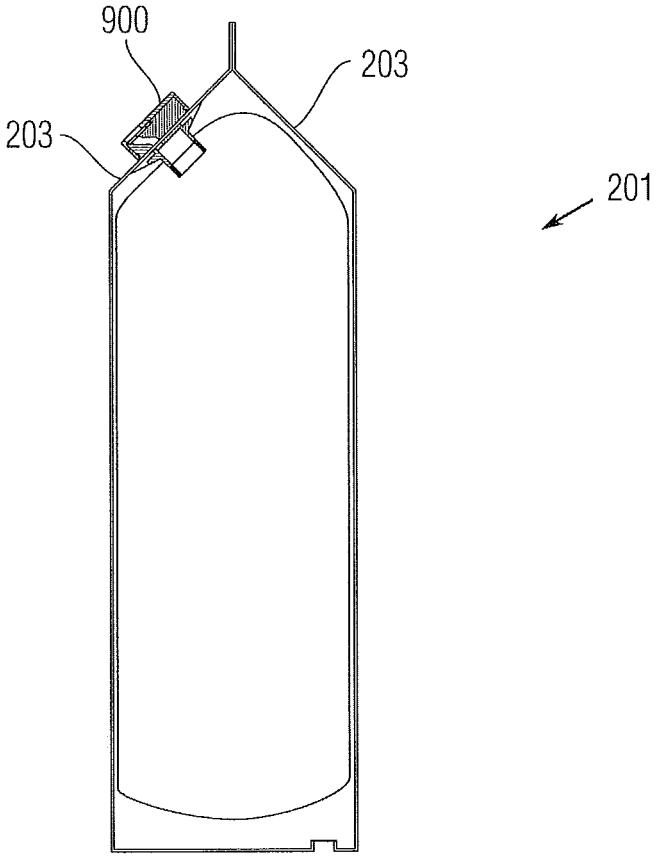
FIG. 10 is a cross-sectional view of a container closure according to another embodiment shown coupled to a container in the form of a carton.

Now referring to FIGS. 1-6, a container closure 100 and container 200 according to one exemplary embodiment are shown. The container 200 can be any number of different types of containers of varying shapes and sizes and can also be formed from any number of different materials. For example and as illustrated, the container 200 can be in the form of a glass bottle; however, it will be appreciated that the container 200 is not limited to being a bottle but instead the container 200 can be any number of different types of suitable receptacles for holding a liquid. For example, the container 200 can be a cask, barrel, box, or the like and as shown in FIG. 10, the container can be a reinforced cardboard container or carton 201. This type of container is often used in the milk and juice industries.

The illustrated container 200 is a bottle that has a base section 210 and a neck portion 220 that terminates in an opening 230 through which the stored liquid product is dispensed. While bottles 200 are usually cylindrically shaped and include a circular opening 230, the bottle 200 can be formed in other shapes.

The container 200 contains a liner 300 that sealingly holds the liquid, such a wine, juice, milk, carbonated drink, etc. The liner 300 is formed of a material that permits the liner 300 to be flexible and collapsible. For example, the liner 300 is typically formed of a plastic material that has sufficient rigidity and has a specific shape to permit reflow of the stored liquid when the liner 300 collapses. In other words, as the bottle 200 is inverted to pour the liquid, the liner 300 is preferably formed so that the liner 200 will not "fall" on itself or otherwise obstruct the flow of the stored liquid through the liner 300 and through the container closure 100. Thus, the liner 300 is designed not to collapse on itself due to the weight of the stored liquid. In order to provide the above properties, the liner 300, according to one embodiment, is generally an ellipsoid or prolate spheroid or oblong shape. Applicants have found that this orientation (shape in its relaxed state) results in the liner 300 maintaining its structure and shape when the liquid is dispensed, thereby preventing obstructions from forming that would restrict the flow of liquid from the interior of the liner 300.

In one embodiment, a bottom 203 of the container 200 includes a supplemental vent 810, such as an opening that is open to atmospheric conditions; however, it will be appreciated that the container 200 does not have to include this vent 810 and instead the bottom can be a completely closed end.

Figure 2:
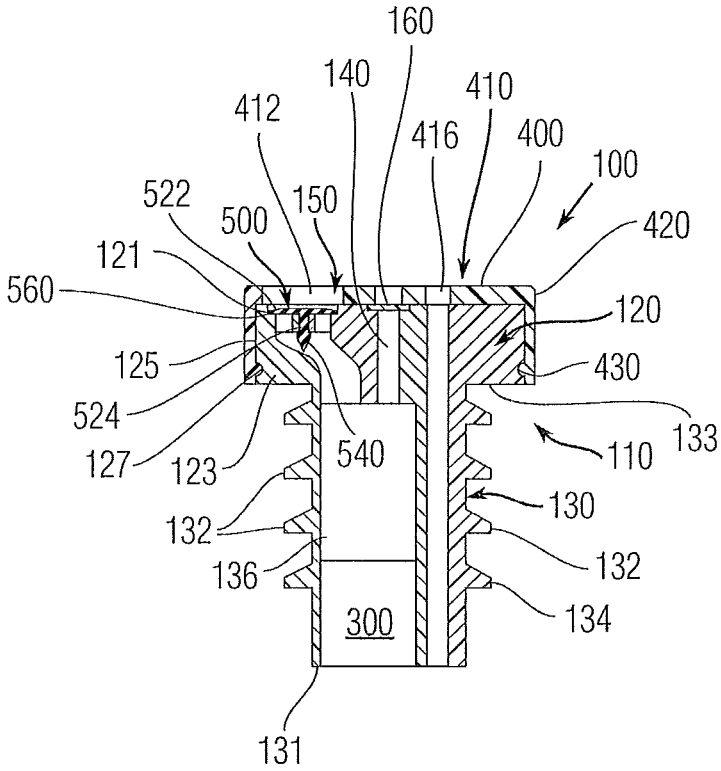
FIG. 2 is a cross-sectional view of the container closure of FIG. 1 in a first position.
Figure 3:
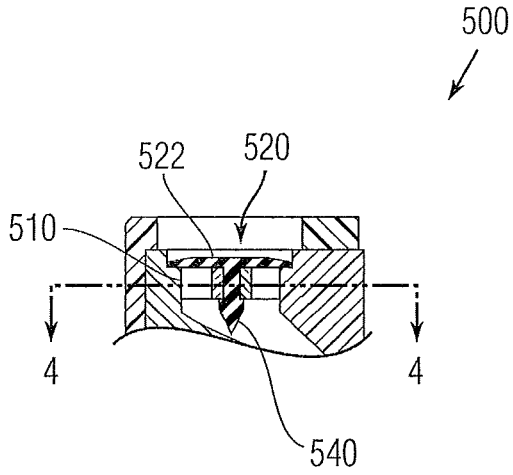
FIG. 3 is a side elevation view of a valve assembly of the container closure of FIG. 2.
Figure 4:
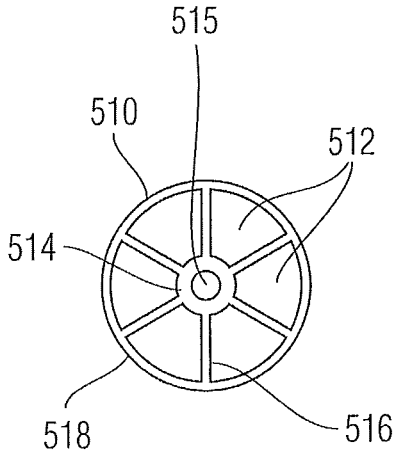
FIG. 4 is a cross-sectional view taken along line 4-4 of FIG. 3.

As best shown in FIG. 2-4, the container closure 100 is in the form of a cap that is sealingly received into the container opening 230 and sealingly engages a sidewall of the neck 220 of the container 200. The container closure 100 includes a main body 110 that has a base section 120 and a stem portion 130 integrally formed therewith and extending outwardly therefrom. The base section 120 and the stem portion 130 are dimensioned and shaped, in view of the shape of the bottle 200, so that insertion of the closure 100 into the opening 230 results in a seal being established between the closure 100 and the neck portion 220. The diameter of the base section 120 is greater than the diameter of the stem portion 130 resulting in the base section 120 extending radially outward and beyond the stem portion 130 and a shoulder 133 is formed. In the illustrated embodiment, the shoulder 133 is a right angled shoulder. The stem portion 130 is designed to be received within the neck portion 220, while the base section 120 remains external to the bottle 200 and the neck portion 220. In other words, when the stem portion 130 is inserted into the neck portion 220, a top edge of the bottle 200 seats near or against the shoulder 133.

In order to sealingly engage the side wall of the neck portion 220, the stem portion 130 can include at least one and preferably a plurality of ribs 132 that have some degree of resiliency. The ribs 132 seal against the inner surface of the sidewall that defines the neck portion 220. When the stem portion 130 has a cylindrical shape, the ribs 132 are in the form of annular shaped ribs that extend radially outward from the stem portion 130.

The stem portion 130 has a first channel 134 formed therethrough. While the first channel 134 can be a linear channel, as illustrated, it can also have a non-linear construction so long as it extends completely through the stem portion 130 and is open at a bottom surface 131 of the stem portion 130. The stem portion 130 also has a main channel or passageway 136 that extends completely therethrough and is open at the bottom surface 131. The first channel 134 and the main channel 136 are separate from one another and never intersect or otherwise communicate with one another along their entire lengths. The dimensions of the main channel 136 are significantly greater than those of the first channel 134 since as described below, the main channel 136 is designed to receive the liquid during a filling operation and is also the channel through which the stored liquid is dispensed, while the first channel 134 acts as a vent channel.

As previously mentioned, the base section 120 is integrally attached to the stem portion 130 and can be formed in situ as a single plastic structure by conventional molding techniques, such as injection molding, etc. The base section 120 defines a top surface 121 of the closure 100 and has a sidewall 123 that has an outer surface 125. When the base section 120 is cylindrically shaped, the outer surface 125 is a circumferential surface. The outer surface 125 includes a retaining feature 127 for coupling a cap member 400 to the base section 120 as described in greater detail below. The retaining feature 127 can be in the form of a circumferentially shaped channel or track that not only couples the cap member 400 to the base section 120 but also permits the cap member 400 to be rotatable relative to the base section 120. In the illustrated embodiment, the retaining channel 127 is located closer to the shoulder 133 than the top surface 121.

The vent channel 134 is also formed through the base section 120 so that it is open at the top surface 121. The vent channel 134 thus extends completely though the base section 120 and stem portion 130 from the top surface 121 to the bottom surface 131. The vent channel 134 can be a linear, circular shaped channel. The base section 120 includes a fill channel or passage 140 that is open at one end at the top surface 121 and forms an entrance and is in communication with the main channel 136 at its opposite end. Similarly, the base section 120 includes a dispensing channel or passage 150 that is open at one end at the top surface 121 and forms an entrance and is in communication with the main channel 136 at its opposite end.

As opposed to the vent channel 134 that typically remains open (except when the cap is in the closed position for storage), the fill channel 140 and the dispensing channel 150 are only selectively open depending upon the position of the closure 100 and whether the liner 300 is being filled with the liquid, the liquid is being dispensed, etc. The fill channel 140 includes a first seal member 160 that extends across the fill channel 140 and seals against a sidewall thereof so as to prevent the free flow of liquid through the fill channel 140. In one embodiment, the first seal member 160 is formed near or at the top surface 121 and is in the form of an elastomeric membrane (septum) that is pierceable. When filling of the liner 300 with liquid is desired, a sharp ended object, such as a cannula, pierces and travels through the septum 160 until the open end of the cannula is in the fill channel 140, thereby permitting the delivered liquid to flow into and through the fill channel 140 into the main channel 136 and ultimately into the liner 300.

Similarly, the dispensing channel 150 is only selectively open to the outside and in particular, the dispensing channel 150 is only open when the user wishes to dispense (pour) an amount of the stored liquid (e.g., wine). While the illustrated dispensing channel 150 has a non-linear construction, this shape is not critical and instead, the dispensing channel 150 can have a linear shape. The dispensing channel 150 includes and contains the valve assembly 500.

It will be appreciated that the closure 100 does not have to have separate dispensing and fill channels 150, 140 but instead a single channel can be formed that is open along the top surface 121 and is in communication with the main channel 136 so long as the valve assembly 500 contained therein permits not only filling but also dispensing of the liquid while maintaining the desired seal properties discussed herein.

The valve assembly 500 is configured to provide the desired seal characteristics discussed herein in that it substantially limits or eliminates the opportunity of the liquid stored in the liner 300 from coming into contact with atmospheric conditions and thus, in contact with oxygen. The valve assembly 500 can therefore be configured as a one-way valve that permits flow of liquid in a direction from the liner 300 and out of the closure 100, while preventing liquid flow in the opposite direction, namely a direction toward the liner 300. In this manner, the valve assembly 500 prevents the dispensing channel 150 from receiving and transferring liquid to the liner 300.

The valve assembly 500 is best shown in FIGS. 3-4. One exemplary valve assembly 500 includes a valve base or valve seat 510 and a valve membrane 520 that is operatively coupled to the valve seat 510. The valve seat 510 is designed to be received within the dispensing channel 150 and provides a structure for supporting the valve membrane 520. As shown in FIG. 4, the valve seat 510 has a circular shape complementary to the circular shape of the dispensing channel 150. The valve seat 510 defines one or more flow channels 512 through which liquid can flow. In the illustrated embodiment, the valve seat has a wheel-like construction in that it includes a center hub 514 and a plurality of spokes 516 that extend radially outward therefrom to a peripheral (annular shaped) outer sidewall 518. Between adjacent spokes 516, one flow channel 512 is formed.

The center hub 514 has a through opening (bore) 515 formed therethrough to assist in coupling the valve membrane 520 to the valve seat 510. The valve membrane 520 is a one way valve that can be in the form of an elastomeric (rubber) disk 522 that has a stem 524 extending outwardly therefrom. The disk 522 is sized so that when the disk 522 is disposed over the valve seat 510 (in a closed position), the disk 522 covers and seals flow channels 512. Accordingly, the disk 522 extends at least radially outward to and preferably, slightly beyond the peripheral outer sidewall 518. The stem 524 of the disk 522 includes a catch 540 that serves to couple the disk 522 to the valve seat 510. In particular, the disk 522 is positioned so that the stem 524 is pointed toward the valve seat 510 and the stem 524 is inserted into and through the bore 515 of the center hub 514. As the stem 524 is inserted into the bore 515, the resiliency of the catch 540 permits it to slightly flex until the catch 540 clears the underside of the valve seat 510. Once the catch 540 extends beyond the underside of the valve seat 510, the catch 540 reverts to its original form and the flexes outward so as to engage the underside of the valve seat 510. Once the catch 540 engages the underside, the valve membrane 520 can not be easily removed from the valve seat 510. In the illustrated embodiment, the catch 540 can be in the form of an annular shaped barb that has a right angle shoulder formed with the stem 524. The valve membrane 520 is designed so that is opens relative to the valve seat 510 only when liquid flows in one direction, namely, when liquid flows out of the liner 300. Conversely, the seating of the valve membrane 520 against the valve seat 510 prevents flow of the liquid through the valve in a direction into the liner 300, thereby preventing the liner 300 from being filled when the valve membrane 520 is shut.

The valve seat 510 is inserted into the dispensing channel 150 and in particular, the valve seat 510 preferably seats against the inner surface of the dispensing channel 150. Due to the spoke construction of the valve seat 510, the insertion of the valve seat 510 into the dispensing channel 150 creates a number of flow channels specifically formed between the spokes of the valve seat 510. For example, the cross-sectional view of FIG. 2 shows a pair of flow channels defined by the valve seat 510. A platform or ledge 560 is formed in the base section 120 and in particular, the platform or ledge 560 is located at or near the end of the dispensing channel 150. The ledge 560 surrounds the dispensing channel 150 and is configured to receive a peripheral edge of the valve membrane 520. In particular, the peripheral edge of the valve membrane 520 sits on the ledge 560 when the valve membrane 520 is in the closed position. This further permits the sealing between the valve assembly 500 and the base section of the closure 100 and prevents atmospheric air from entering the dispensing channel 150 and flowing into the liner 300 that stores the liquid. By providing a one-way valve assembly 500 in the dispensing channel, the effects of oxidation can be eliminated or at least substantially eliminated or reduced since oxygen can not freely flow into the liner 300 after the container has been opened. During the dispensing of the liquid from the liner 300 through the dispensing channel 150, the flow of the liquid through the dispensing channel 150 prevents inflow of oxygen into the dispensing channel 150 and the liner 300. Since the fill channel 140 is sealed by the septum 160, oxygen cannot likewise flow through this channel and into contact with the liquid stored in the liner 300. As described below, the vent channel is not in communication with the interior of the liner 300 and therefore, gas (atmospheric gas) that is permitted to flow into and through the vent channel does not come into contact with the liquid stored in the liner 300.

It will also be appreciated that instead of being a separate part, the valve assembly 500 can be formed as part of the closure 100 and in particular, part of the base section thereof. In this embodiment, the valve assembly 500 functions in the same manner in that the valve membrane 520 opens only when liquid from the liner 300 is being poured but otherwise remains closed.

The cap member 400 is designed to be rotatably coupled to the base section 120 for positioning the cap in any number of different operating positions. The cap 400 has a top wall or base section 410 and a sidewall 420 extending outwardly therefrom at a peripheral outer edge thereof. For example, the sidewall 420 can be formed at a right angle relative to the base section 410. An inner surface of the sidewall 420 includes a retaining feature 430 that is complementary to the retaining feature 127 (circumferentially shaped channel or track). The retaining feature 430 can be in the form of a protrusion, tab or rib that engages the retaining features 127 so as to couple the cap member 400 to the base section 120 in a manner where the base section 120 is sealed but the cap member 400 can rotate relative thereto. In the illustrated embodiment, the retaining feature 430 is in the form of an annular shaped rib formed along the inner surface of the sidewall 420. The complementary retaining features 127, 430 permit a snap-locking fit between the cap member 400 and the base section 120 while still permitting the cap member 400 to rotate relative to the base section 120. It will be appreciated that, in one embodiment, the rib 430 does not have to extend completely around the inner surface of the sidewall 420 but instead can be segmented into different sections that still permit a snap-fit coupling and rotation of the cap member 400.

The base section 410 has first, second and third openings 412, 414, 416 formed therethrough. The first opening 412 acts as a dispensing opening and is sized in view of the dimensions of the dispensing channel 150 such that when the first opening 412 is in registration with the dispensing channel 150, liquid can freely flow through the cap closure 100 including the cap member 400. The second opening 414 acts as a fill opening and is sized in view of the dimensions of the fill channel 140 such that when the second opening 414 is in registration with the fill channel 140, liquid can freely flow through the cap member 400 into the fill channel 140, when the septum is pierced, and into the liner 300. The third opening 416 acts as a vent opening and is sized in view of the dimensions of the vent channel 134 such that when the third opening 416 is in registration with the vent channel 134, air can freely flow through the cap member 400 into the vent channel 134, as well as flowing through the vent channel and out of the cap member 400.

Figure 5:
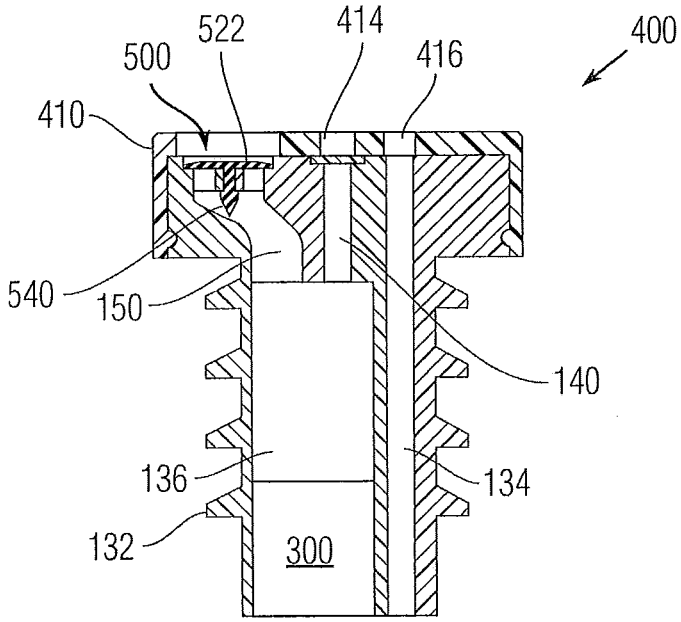
FIG. 5 is a cross-sectional view of the container closure of FIG. 1 in a second position.
Figure 6:
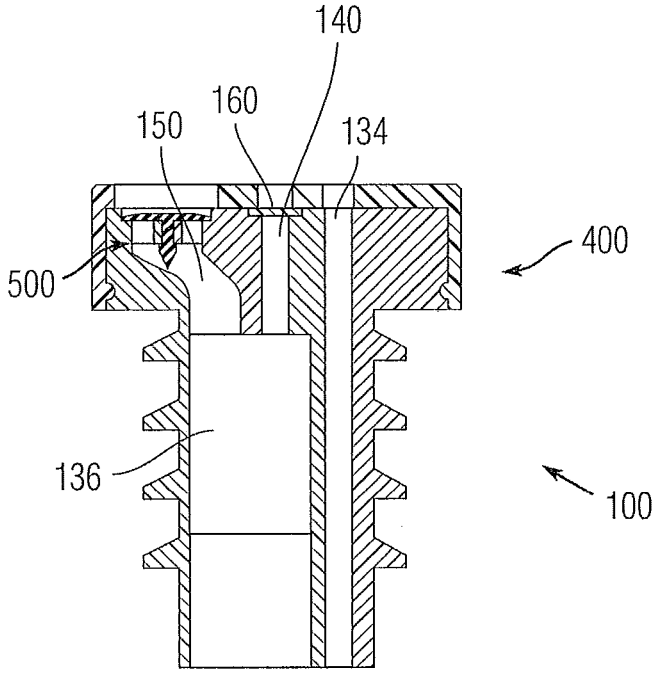
FIG. 6 is a cross-sectional view of the container closure of FIG. 1 in a third position.

FIG. 2 shows the cap member 400 in a first position which is a dispensing position where the first opening 412 is in registration with the dispensing channel 150 to permit flow of the liquid out of the liner 300 as when the user pours the contents of the container into a glass. It will be seen that in this first position, the fill channel 140 is closed, while the vent channel 134 is open. FIG. 5 shows the cap member 400 in a second position which is a fill position where the second opening 414 is in registration with the fill channel 140, the vent channel 134 is open due to its registration with the third opening 416, and the dispensing channel 150 is closed. In order for the vent channel 134 to be both open in the first and second positions, the cap member 400 can include a pair of third openings 416 that are spaced apart from one another (e.g., 180 degrees). FIG. 6 shows the cap member 400 in a third position which is a closed or store position where each of the dispensing channel 150, the fill channel 140 and the vent channel 134 are closed due to none of the openings in the cap member 400 being in registration with the respective channels.

Figure 1:
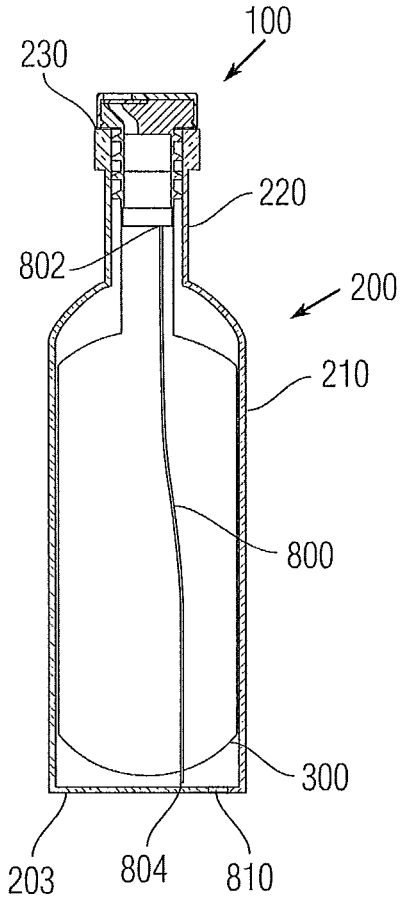
FIG. 1 is a cross-sectional view of a container closure and container according to one embodiment.
Figure 7:
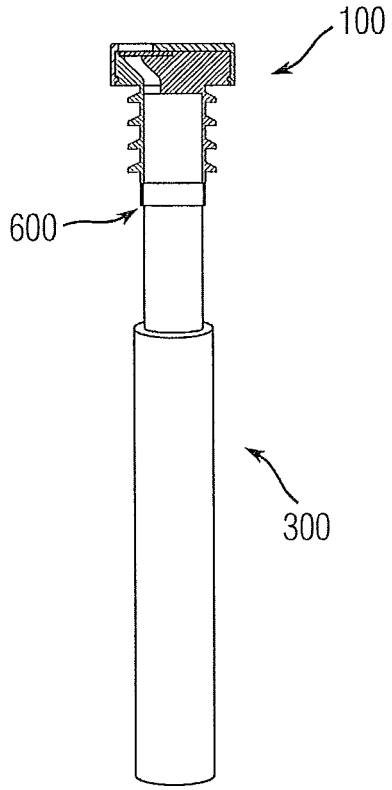
FIG. 7 is side view of a completed and packaged cap liner assembly.
Figure 8:
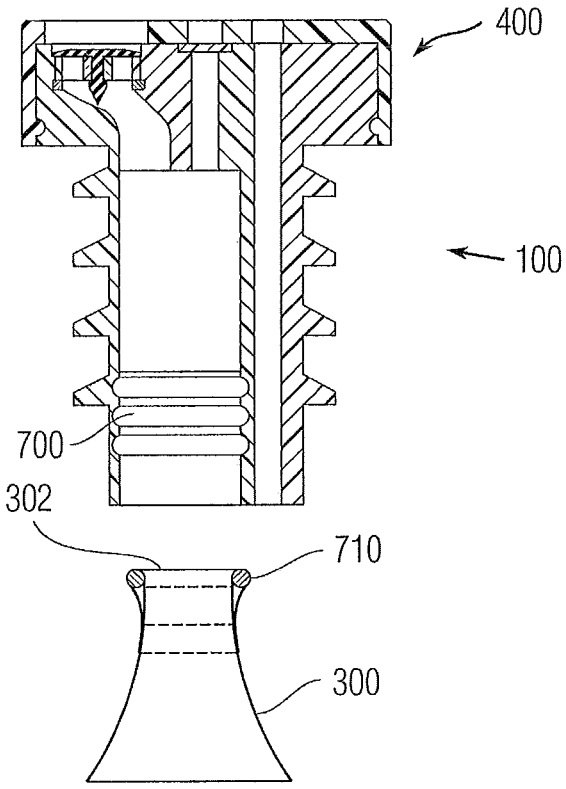
FIG. 8 is a cross-sectional view of a container closure according to another embodiment with a liner portion according to one embodiment shown exploded
Figure 9:
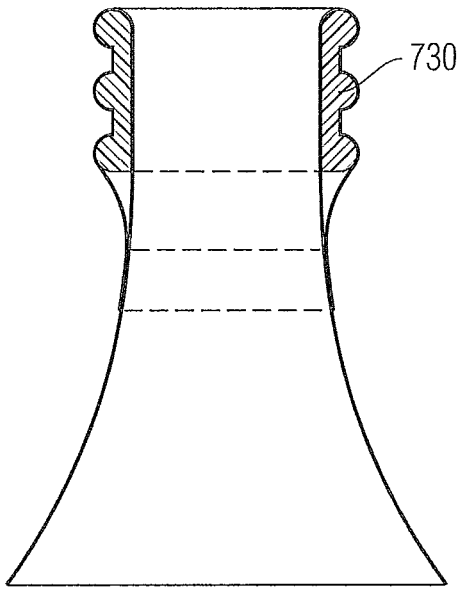
FIG. 9 is a cross-sectional view of a portion of a liner according to another embodiment.

Now referring to FIGS. 7-9, a liner retention member 600 is provided for securely attaching the liner 300 to the cap closure 100 and in particular, to the stem 130 thereof. The liner 300 has a first end 302 that is configured to be sealingly coupled to the main channel 136 so that liquid can both be delivered to the liner 300 and can be dispensed from the liner 300. FIG. 7 shows the liner 300, in a rolled state, attached to the cap closure 100 and ready for insertion into the container 200 (FIG. 1). Since the liner 300 is rolled up, the liner 300 can be threaded through the neck portion of the container 200 and into the larger base section 210 of the container 200 (FIG. 1). The liner 300 is rolled up in such a way that once the liquid is filled therein, the liner 300 expands outward and unrolls itself.

Any number of different techniques, can be used to securely attach the liner 300 to the inner surface of the main channel 136 so that the inside of the liner 300 is in fluid communication with the main channel 136. For example, a heat weld or the like can be used to sealingly attach the liner 300 to the inside of the main channel 136. Alternatively and as shown in FIGS. 8-9, the liner 300 can be attached to the closure 100 by means of male/female engagement members.

For example, the main channel 136 includes a first engagement member 700 that is complementary and configured to engage a second engagement member 710 that is associated with the liner 300. The intimate engagement between the members 700, 710 results in a secure, sealed connection between the liner 300 and the closure 100. For example, the first engagement member 700 can be a male fastening feature and the second engagement member 710 can be a female fastening feature or conversely, the first engagement member 700 can be a female fastening feature and the second engagement member 710 can be male fastening feature.

According to one embodiment, the first engagement member 700 is in the form of a plurality of annular grooves that are arranged one on top of the other. The second engagement member 710 is in the form of a ring structure that is shaped (annular shape) to be received within the annular grooves 700 so as to securely attach the liner 300 to the container closure 100. The plastic ring 710 snap-fittingly engages the annular grooves 700 so as to attach the liner 300 to the closure 100. The liner 300 is attached to the plastic ring 710 using traditional techniques, such as bonding the plastic ring 710 the liner 300. FIG. 9 shows an embodiment where the liner 300 is attached to a plastic ring structure 730 that includes multiple rings that engage multiple annular grooves 700.

In addition, it will be appreciated that the liner 300 can be formed with the container closure 100 as a single, integral structure. For example, the liner 300 can be integrally attached to the closure 100 in situ by means of a molding operation, such as an injection molding operation. In addition, the liner 300 and closure 100 can be formed in a blow molding operation or any other type of technique that permits the closure 100 and the liner 300 to be formed as an integral unitary structure. In addition, the liner 300 can be attached to the stem 130 using a heat seal between the two members. Also, a combination of coupling techniques can be used. For example, the liner 300 can be attached by a snap-fit mechanism (male/female members) and a heat seal.

The liner 300 can be formed of a number of different compositions, including different grades of plastic material, so long as the liner 300 functions in the manner described above. In addition, the liner material can have preservatives or other additives incorporated therein and selected in view of the liquid that is being stored therein. For example, the preservatives and liner material can be selected for storing highly acidic liquids, such as juices.

In addition, the cap closure system can optionally include a vent line or tube 800 (FIG. 1) that is operatively connected to the vent channel 134 at a first end 802 and is open at a second end 804. The second end 804 can be located proximate the bottom of the container 200. The vent line 800 is disposed outside of (external to) the liner 300. The vent line 800 is designed to introduce air into the interior of the bottle 200 so as to regulate the pressures within the container 200 and the liner 300. This is especially true when the liner 300 is not in the preferred ellipsoid or prolate spheroid or oblong shape but instead has a more oval or rounded shape. These other shapes have a greater tendency to collapse when liquid is poured out of the container 200 and thus out of the liner 300. Thus, by introducing air into the interior of the container 200, atmospheric pressure can be maintained in the container to reduce the likelihood that the liner 300 collapses and folds over itself.

As mentioned above, the container 200 can include the supplemental vent 810 that provides an additional means for venting the interior of the container 200.

Figure 11:
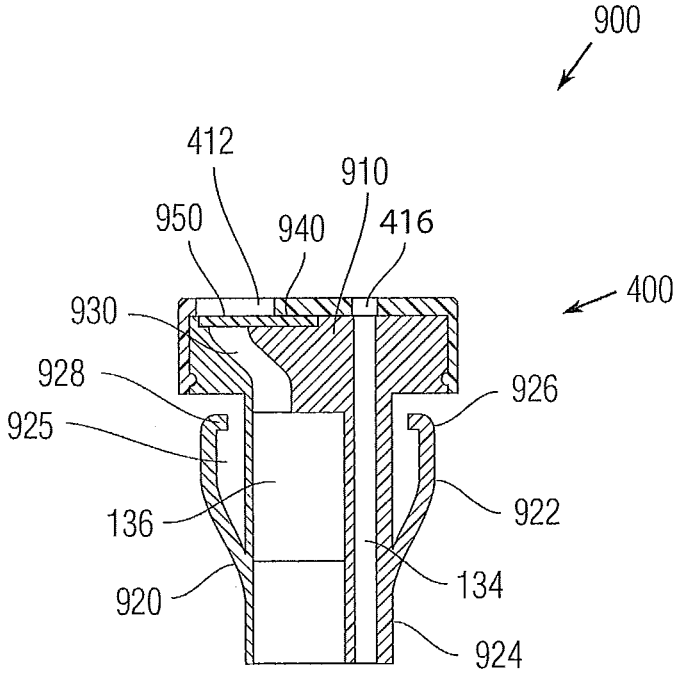
FIG. 11 is a cross-sectional view of container closure according to one exemplary embodiment.

Now referring to FIGS. 10 and 11 in which a container 201 in the form of a carton is shown. The carton 201 is formed of a paper material, such as reinforced cardboard, and can be laminated along its inner surface. This type of container 201 is typical for holding milk products and juice products. The carton 201 has a pair of beveled top walls 203 one of which include a pour spout or opening through which the contents of the carton 201 can be poured.

When the container is in the form of a carton 201, a container closure 900 is provided and is or can be similar in construction to the container closure 100 and therefore, like elements are numbered alike. In the illustrated embodiment, the closure includes a base section 910 and a stem 920 that extends outwardly therefrom. As previously mentioned, the main channel 136 is only in communication with a single channel, namely channel 930. The channel 930 extends from the main channel 136 to a top surface 911 of the base section 910. The vent channel 134 is also provided and extends through the base section 910 and the stem 920. The base section 910 has a recessed platform 940 that is formed along the top surface 911 for receiving a valve member 950. In this embodiment, the valve member 950 is configured to not only receive liquid when valve member 950 is in an open position and also to dispense liquid when the valve member 950 is also in the open position. The shape and dimensions of the valve member 950 are selected so that the valve member 950 completely occludes the channel 930 when the valve member 950 is closed.

The valve member 950 is disposed and seats within the recessed platform 940. One type of one way valve 950 is a flapper valve. The valve member 950 is attached to the base section 910 (e.g., at one edge or end of the platform floor) at a location spaced from the channel 930. The valve member 950 is naturally closed so as to close off the channel 930. When using one valve member 950 for both the filling and dispensing operations, the valve member 950 must be opened to permit a filling conduit to be received into the channel 930 to deliver the liquid to the liner 300. For example, the valve member 950 can be lifted sufficiently off the platform 940 by application of a negative force (vacuum source) to permit the filling conduit to be disposed into the channel 930 for delivering the liquid into the liner 300. Conversely, when liquid is dispensed from the liner 300 as by pouring the liquid from the liner 300, the valve member 950 opens under the force of the flowing liquid.

The cap member 400 in this embodiment only includes the channels 412 and 416 but does not include a separate fill channel 414.

Unlike the stem 130 of the container closure 100, the stem 920 in this embodiment does not include ribs 132 (FIG. 2) since the stem is not received within a bottle neck portion or the like. Instead, the stem 920 includes a flexible prong, claw structure or the like 922. The prong structure 922 has a first end 924 that is integrally formed with the stem 920 and an opposite free second end 926. The resiliency of the prong structure 922 permits flexing of the prong structure 922 when a force is applied thereto. The prong structure 922 extends away from the stem 920 and extends vertically along a length of the stem 920 so that a space 925 is formed between the prong structure 922 and the stem 920. At the free second end 926, an inward lip 928 is provided. The lip 928 and second end 926 is spaced from the right angled shoulder 133.

When the container closure 900 is inserted into the opening formed in the container 201, the resilient prong structure 922 flexes inward into the space 925 to permit the insertion of the stem 920 into the interior of the carton 201. Once the prong structure 922 clears the carton wall that contains the opening, the prong structure 922 releases its stored energy and flexes back outward to its rest position, thereby causing the prong structure 922 to engage the underside of the carton wall. This action results in the container closure 900 being securely attached in the carton 201 and it can not be simply pulled out from the carton wall due to the prong structure 922 engaging the underside of the carton wall around the carton wall opening.

As mentioned above, the container closure 900 does not include separate dispensing and fill channels; however, it can easily be formed such that it includes these two separate channels. In other words, the base section of the closure 900 can be the same as the base section of the closure 100 of FIG. 2. It will also be appreciated that other fill techniques, besides lifting the flap valve 950, can be used to fill the liner 300. For example, when a carton 201 is used, the liner 300 can be filled and then the bottom of the carton 201 can be formed and sealed so as to enclosure the liner 300 in the carton 201.

Figure 12:
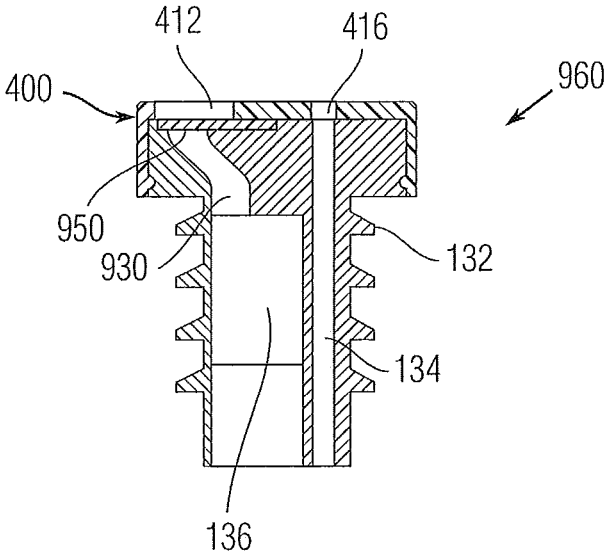
FIG. 12 is a cross-sectional view of a container closure according to yet another embodiment.
Figure 13:
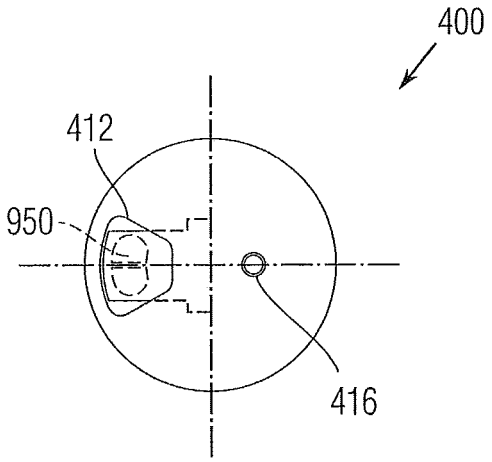
FIG. 13 is a top plan view of the closure of FIG. 12 in an open position.
Figure 14:
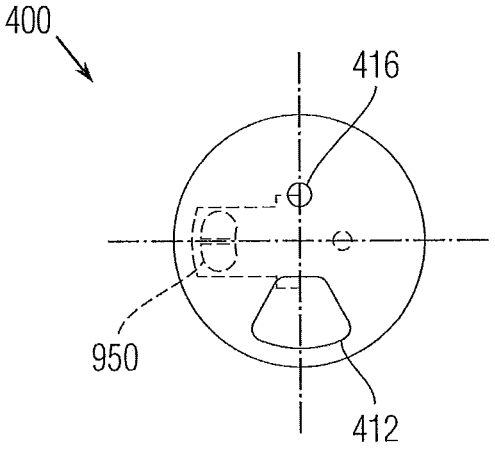
FIG. 14 is a top plan view of the closure of FIG. 12 in a closed position.

Now referring to FIGS. 12-14, a container closure 960 is illustrated and includes features found in both the closures 100 and 900. More specifically, the closure 960 includes the valve membrane 950 (flap valve); however, instead of having the prong structure 922, the stem of the closure 960 includes the ribs 132 found in the closure 100. The closure 960 can be thought of as a closure for a bottle type container, such as container 100 of FIG. 1 in combination with a flap valve 950 as opposed to the disk valve of FIG. 1. FIG. 13 shows the cap 400 in an open position where valve membrane 950 is accessible and FIG. 14 shows the cap 400 in a closed position where the valve membrane 950 is not accessible.

Figure 15:
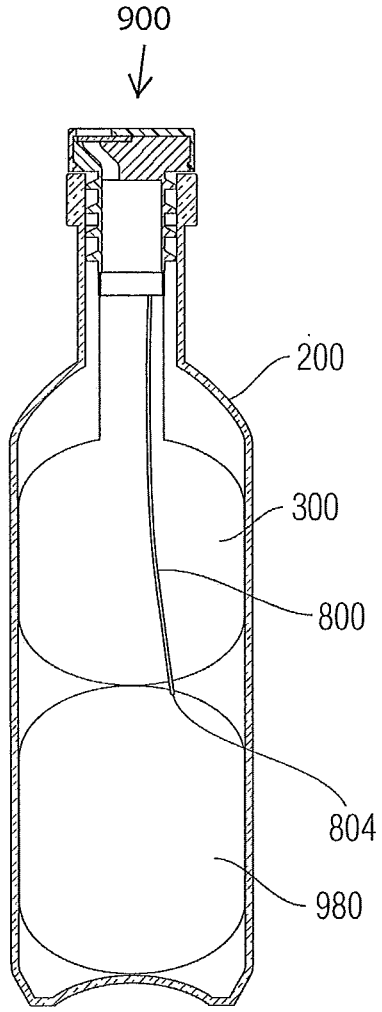
FIG. 15 is a cross-sectional view of a container closure and container according to another embodiment.

FIG. 15 shows another embodiment of a combination of the closure 900 and container 200. This embodiment is particularly suited for carbonated beverages, such as soda or champagne. The second end 804 of the vent tube 800 is attached to an expandable structure 980 such that air delivered through the vent tube 800 can cause expansion of the structure 980 within the bottle 200. The expandable structure 980 is disposed below the liner 300 in that it is located between the liner 300 and the bottom of the bottle 200. The structure 980 can be in the form of a bellows structure or gas cell or a plastic bag-like structure. As the liquid is dispensed from the liner 300 and the liner 300 begins to collapse, the gas cell 980 expands so as to exert a force against the liner 300. In addition, when the gas cell 980 is expanded, it prevents expansion of the liner 300 when pouring the liquid. The expansion of the liner 300 is undesirable since it creates more space in the liner 300 which can lead to the liner 300 folding over itself and obstructing liquid flow.

One of the advantages of the present invention is that it is an environmentally friendly product. More specifically, the container, such as bottle 200, can be recycled and it is also contemplated that a user can simply maintain the container structure and use separate, new liners 300 for filling the bottle repeatedly with different products. Conventional containers were formed of multiple materials that led to increased waste and potential harm to the environment.

The present invention is thus directed to a cap and liner system that preserves the liquid product contained in the liner due to the valve system incorporated into the cap. Further, by attaching the liner to the cap and then rolling the liner, the assembly takes up very little room and is conveniently stored and simple to use since the user simply inserts the assembly into the bottle and then adjusts the cap member to the proper position, such as a fill position, a dispensing position, or closed position. When the product is gone, the user simply removes the cap and liner assembly and then can insert a new assembly that receives a new product.

It will also be appreciated that the cap closures of the present invention incorporate two valves or enclosures with one being rotatable relative to the other and positionable in different positions. It will also be understood that the cap 400 of the various embodiments can incorporate a return mechanism (spring loaded) or otherwise be biased so as to include an auto-return. For example, the cap 400 can be spring loaded so as to always return to a rest position which is the closed position of the cap shown in FIG. 6 where none of the channels are open. To move the cap 400 to another position, the user simply rotates the cap and performs the intended operation, such as filling or dispensing, and then releases the cap 400 to cause the cap 400 to return automatically to the closed position. In addition, the cap 400 can incorporate locking tabs or the like to temporarily lock the cap 400 in one of the positions.

Figure 16:
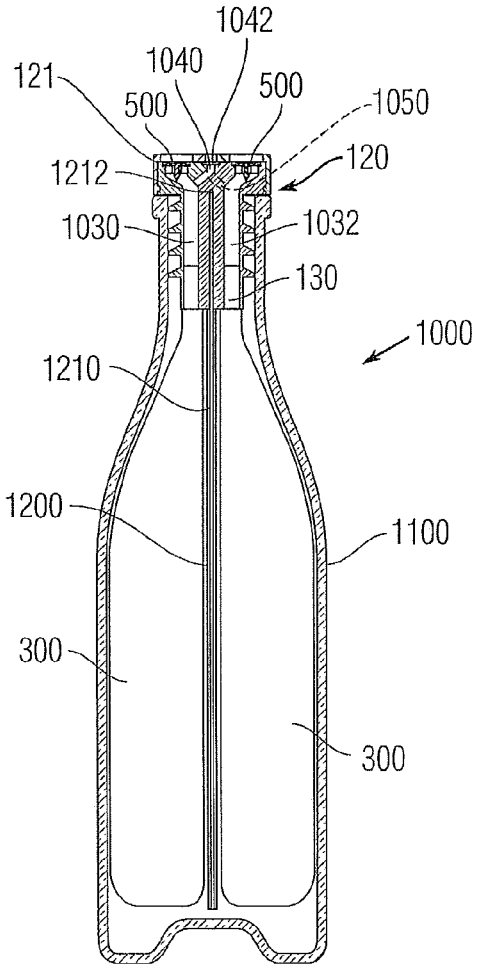
FIG. 16 is a first cross-sectional view of a container closure and container according to a different embodiment.
Figure 17:
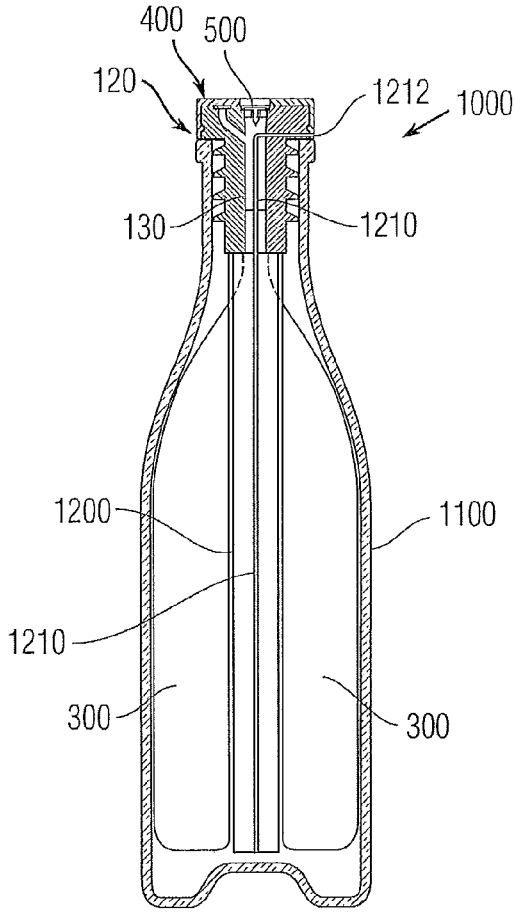
FIG. 17 is a second cross-sectional view of the closure and container of FIG. 16.
Figure 18:
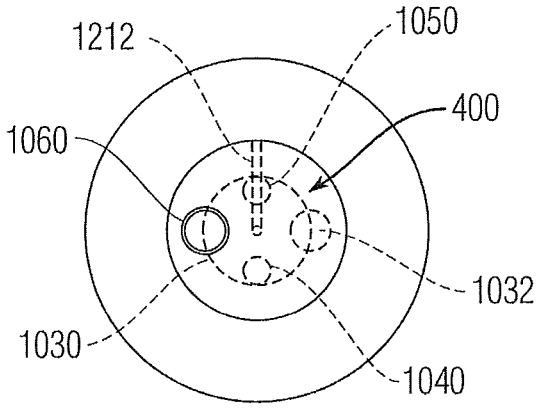
FIG. 18 is a top plan view of the closure of FIG. 16 in one position.

Now referring to FIGS. 16-18 in which a container closure 1000 according to another embodiment is illustrated. The closure 1000 is similar to the other closures described herein with the exception that the closure 1000 is configured to operate with a dual storage container 1100. More specifically, the dual storage container 1100 is constructed to hold two separate liquids. This arrangement permits the user one convenient container 1100 that can hold two different liquid (or the same liquid in separate storage means is also possible). For example, when the container 1100 contains a wine product, the container 1100 can hold either two different varietals of white wine, two different varietals of red wine or a combination of one white and one red wine in a single bottle. When the container 1100 stores other liquids, such as juices, the container 1100 can include two complementary juices, such as orange juice and pineapple juice, each stored separately. This permits the user to conveniently and easily mix the two juices in a single glass or of course, the user can simply pour one type of juice into a single glass.

In this embodiment, the closure 1000 has dual functionality in that it seals and permits dispensing of the two liquids. The two liquids are stored in two liners 300 that can be the same or similar to the liners 300 described above. In order to impart some stability and rigidity and keep the two liners 300 separate from one another, a separator 1200 is provided and made of a rigid material, such as a rigid plastic. The separator 1200 is disposed between the two liners 300. The separator 1200 can be in the form of a plastic rectangular strip that extends along the lengths of the liners 300. The separator 1200 also incorporates a venting feature in that a vent line 1210 (vent tube) is provided and extends the length of the separator and terminates in a distal vent port 1212 that is positioned near a bottom floor of the container 1100 when the closure 1000 and liners 300 are disposed within the container 100. In one embodiment, the vent line 1210 is formed integrally within the elongated separator 1200 as by a molding process and in an alternative embodiment, the vent line 1210 is a separate member that is attached to the separator 1200 and extends along a length thereof.

It will also be appreciated and as described below, the separator 1200 can be directly formed as a part of the closure 1000.

The closure 1000 includes the base section 120 and the stem portion 130. In this embodiment and unlike the other embodiment, a vent channel 1010 is formed in the stem 130 and base section 120 and is in communication with the vent line 1210. However, the vent channel 1010 does not terminate at the top surface of the base section 120 but instead, the vent channel 1010 has a right angle (or other angle) construction and terminates in a vent outlet or port 1012 that is open along a side wall of the base section 120. The position of the vent port 1012 is such that even when the closure 1000 is inserted into the container 1100, the vent port 1012 remains exposed to atmospheric conditions.

The closure 1000 contains dual channel architecture to permit filling and dispensing of two liquids into and out of the two different liners 300. The stem portion 130 includes a first main channel 1030 and a second main channel 1032, each of which is similar to the main channel 136. The first main channel 1030 is in fluid communication with the first liner 300 for filling and dispensing liquid therefrom, while the second main channel 1032 is in fluid communication with the second liner 300 for filling and dispensing liquid therefrom. In this design, the first main channel 1030 acts as the dispensing channel for the first liner 300 and is open along the top surface 121 of the base section 120. Similarly, the second main channel 1032 is also open along the top surface 121. The first and second main channels 1030, 1032 can be linear channels or they can have a slight bend in the channel.

The closure 1000 includes the valve assembly 500 and in particular, each of the first and second main channels 1030, 1032 includes one valve assembly 500 that is made up of one valve base or valve seat 510 and one valve membrane 520 that is operatively coupled to the valve seat 510. The valve assembly 500 can be oriented as in the previous embodiment in that the valve membrane 520 sits against the ledge formed within and surrounding one of the first and second main channels 1030, 1032.

The closure 1000 also includes a first fill channel 1040 that is formed in the base section 120 and is in communication with the first main channel 1030 and a second fill channel 1050 that is formed in the base section 120 and is in communication with the second main channel 1032. The first and second fill channels 1040, 1050 are separate from one another and offset from one another. For example, the first and second channels 1040, 1050 can be formed about 180 degrees from one another.

The first fill channel 1040 includes a first pierceable seal membrane 1042 that seals the first fill channel 1040 and the second fill channel 1050 includes a pierceable seal membrane 1042 that seals the second fill channel 1050. For example, each of the first and second seal membranes 1042 can be in the form of a pierceable septum made of an elastomeric material. The membranes 1042 seal the respective channels 1040, 1050 and permit filling of the first and second liners 300 by piercing the membrane 1042 with a cannula or the like and then liquid is delivered to the liner 300 for filling thereof.

In the illustrated embodiment and as shown in FIG. 18, the first main channel 1030 and the second main channel 1032 are about 180 degrees apart from one another and therefore, the first and second main channels 1030, 1032 are about 90 degrees from the pair of fill channels 1040, 1050.

The cap member 400 is rotatably coupled to the base section 120 as in the manner described above (e.g., snap fittingly) . The cap member 400 includes respective openings for aligning with the respective channels formed in the base section 120. For example, the cap member 400 includes at least one opening 1060. When it is desired to dispense the liquid in the first liner 300, the cap member 400 of the closure 1000 is rotatably adjusted so that the cap opening 1060 is aligned with the first main channel 1030, thereby permitting the liquid in the first liner 300 to be dispensed. In this cap position, the second main channel 1032 and the fill channels 1040, 1050 are closed and offset from the cap opening 1060. When it is desired to dispense the liquid in the second liner 300, the cap member 400 of the closure 1000 is rotatably adjusted so that the cap opening 1060 is aligned with the second main channel 1032, thereby permitting the liquid in the second liner 300 to be dispensed (the channels 1030, 1040, 1050) remain closed. When it is desired to fill the first liner 300, the cap member 400 of the closure 1000 is rotatably adjusted so that the cap opening 1060 is aligned with the fill channel 1040, thereby permitting liquid to be delivered into the first liner 300 (the channels 1030, 1032, 1050) remain closed. When it is desired to fill the second liner 300, the cap member 400 of the closure 1000 is rotatably adjusted so that the cap opening 1060 is aligned with the fill channel 1050, thereby permitting liquid to be delivered into the second liner 300 (the channels 1030, 1032, 1040) remain closed.

In this manner, the closure 1000 permits selective closure and opening of one of the liners 300 for either dispensing of the contents thereof or for delivering liquid into one of the liners 300. The user can therefore select which liquid to dispense at which time. At the same time, the contents (liquids) of the liners 300 are sealed within the liners 300, thereby preventing the contents from being exposed to atmospheric conditions (e.g., oxidation). Since the vent line and vent port are always open and active, the cap member 400 is only rotated to cause opening and exposure of the channels 1030, 1032, 1040, 1050. FIG. 18 reflects this orientation and design of the cap member 400.

FIGS. 19-22 illustrate a container closure 1300 for use with a container 1500 that includes a liner for holding liquid. The container closure 1300 is in the form of a cap that is sealingly received into a container opening 1510 and sealingly engages a sidewall of a neck 1520 of the container 1500. The container closure 1300 includes a main body 1320 that has a base section 1330 and a stem portion 1340 integrally formed therewith and extending outwardly therefrom. The container closure 1300 also includes a separate sleeve member 1400. The base section 1330, the stem portion 1340, and the separate sleeve member 1400 are dimensioned and shaped, in view of the shape of the bottle 1500, so that insertion of the closure 1300 into the opening 1510 results in a seal being established between the closure 1300 and the neck portion 1520. The diameter of the base section 1330 is greater than the diameter of the stem portion 1340 resulting in the base section 1330 extending radially outward and beyond the stem portion 1340 and a shoulder 1333 is formed. In the illustrated embodiment, the shoulder 1333 is a right angled shoulder. The stem portion 1340 and sleeve member 1400 are designed to be received within the neck portion 1520, while the base section 1330 remains external to the bottle and the neck portion 1520. In other words, when the stem portion 1340 and sleeve member 1400 are inserted into the neck portion 1520, a top edge of the container seats near or against the shoulder 1333.

In order to sealingly engage the side wall of the neck portion 1520, the sleeve member 1400 can include at least one and preferably a plurality of ribs 1402 that have some degree of resiliency. The ribs 1402 seal against the inner surface of the sidewall that defines the neck portion 1520. When the sleeve member 1400 has a cylindrical shape, the ribs 1402 are in the form of annular shaped ribs that extend radially outward from the sleeve member 1400.

The sleeve member 1400 is a hollow member that has a first end 1410 and an opposing second end 1412. The first end 1410 includes an enlarged flange member 1420 that extends radially outward beyond the ribs 1402. The first end 1410 defines a planar surface that is intended to seat against an underside 1337 of the base section 1330 when the closure 1300 is in the closed position shown in FIGS. 19 and 20. The underside 1337 is also a planar surface and therefore the two surfaces 1337, 1410 can seat flush against one another in the close position.

The illustrated sleeve member 1400 has a cylindrical shape due to the cylindrical shape of the neck portion of the bottle 1500; however, other shapes are possible so long as the two are complementary. In addition, the central opening or bore 1421 that extends through the sleeve member 1400 has a circular shape in the illustrated embodiment and has a diameter that is complementary to the stem portion 1340 of the closure 1300. More specifically, the stem portion 1340 is slidingly movable within the bore 1421; however, when the stem portion 1340 is inserted into the bore 1421, a seal is formed between the stem portion 1340 and the sleeve member 1400. In other words, the outer diameter of the stem portion 1340 is slightly less than the diameter of the bore 1421 to allow for a frictional seal to be formed between the two members; however, the stem portion 1340 can be slidingly moved within the bore 1421. As described below, it is the axial (vertical) movement of the base section 1330 and stem portion 1340 within the bore 1421 that allows for the closure 1300 to be moved between the closed position shown in FIGS. 19 and 20 and the open position shown in FIG. 21.

Figure 20:
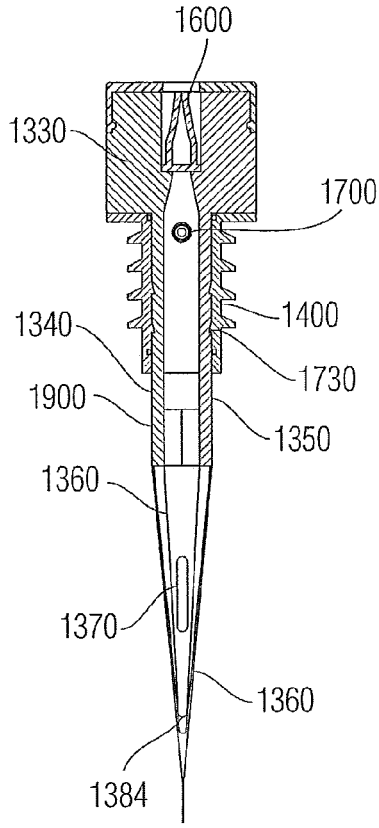
FIG. 20 is a side elevation view of the closure of FIG. 19.

The illustrated stem portion 1340 is an elongated structure that is in the form of a flow spike at a distal end thereof. The stem portion 1340 has a first section 1350 that has an at least substantially constant diameter and a second section 1360 that has a variable diameter. The second section 1360 includes the distal end of the stem portion 1340, while the first section 1350 includes the interface between the base section 1330 and the stem portion 1340. The flow spike of the stem portion 1340 can include a pair of planar surfaces (e.g., front and rear faces) that are angled relative to one another such that they converge and are joined at the distal end. At least one and preferably at least two openings 1370 are formed in the stem portion 1340 to allow for fluid to freely pass between a hollow interior of the stem portion 1340 and a hollow interior of the bottle 1500. In the illustrated embodiment, there is a pair of openings 1370 in the form of side slots or openings (e.g., oval or oblong shaped slots formed along the sides of the stem portion 1340 as shown in FIG. 20). The spacing of the openings 1370 can be selected; however, in the illustrated embodiment, the slots 1370 are spaced about 180 degrees apart from one another). While a distal section of the hollow interior of the stem portion 1340 lies below the side openings 1370, this distal section is not open to the exterior so the main point of entry and exit between the interior of the stem portion 1340 and the interior of the bottle 1500 is through the side slots 1370.

The overall shape of the stem portion 1340 can be thought of as having a flattened conical shape.

The closure 1300 include a main channel or conduit 1380 that is formed therein such that the main channel 1380 is formed both within the base section 1330 and the stem portion 1340. One end of the main channel 1380 is open along the top surface of the base section 1330, while an opposite end terminates in the distal section of the hollow stem portion 1340 below the side slots 1370. However, the main channel 1380 can terminate at the slots 1370. The main channel 1380 can have a linear shape or it can have an irregular shape. In the illustrated embodiment, the main channel 1380 has an irregular shape in that it has a linear section that is formed in the stem portion 1340 and has a bent section that is formed in the base section 1330 prior to becoming a linear section near the planar top of the base section 1330. The main channel 1380 thus has a first end 1382 that is open along the top planar surface of the base section 1330 and a second end 1384 that terminates at or proximate the slots 1370.

In accordance with this embodiment, the main channel 1380 serves as both a dispensing channel and a fill channel as described below. A first vale 1600 is provided in the main channel 1380 near the first end 1382 and serves as a dispensing valve that opens when it is desired to dispense fluid from the bottle 1500. The main channel 1380 can be formed to have slightly larger diameter section near its first end 1382 to accommodate the first valve 1600. The first valve 1600 can have any number of different types of valve structures. Since the first valve 1600 is a dispensing valve that opens only when liquid is desired to be dispensed from the bottle 1500, the first valve 1600 is a one-way valve. For example, the first valve 1600 can be a duckbill valve that opens as fluid flows into the main channel 1380 from the bottle 1500 and toward the first end 1382 thereof. The opening of the first valve 1382 allows for the fluid (e.g., wine) to be dispensed from the bottle 1500.

The duckbill valve 1600 can have a diameter substantially the same as the diameter of the main channel 1380 with a screw/turn and displace top for products without contamination risk. For products with a contamination risk, an anti-pooling collar, generally shown at 1601, can be used in conjunction with the duckbill valve 1600.

When the bottle 1500 assumes a dispensing position, the fluid that is contained in the bottle (inserted liner thereof) flows through the slots 1370 and into the main channel 1380. The fluid flows along and within the main channel 1380 toward the first end 1382 and when the fluid contacts the duckbill valve 1600, it applies a sufficient force in the correct direction to cause the duckbill valve 1600 to open and allow the fluid to flow through the open end 1382. When the container 1500 is not in a dispensing position, the duckbill valve 1600 assumes a closed position and no fluid passes therethrough.

As previously mentioned, the main channel 1380 serves as both the dispensing channel and the fill channel and therefore, the closure 1300 includes a second valve 1700 that serves as a fill valve. The second valve 1700 can be any number of different types of valves and in one embodiment, similar to the first valve 1600, the second valve 1700 is in the form of a duckbill valve (e.g., a preloaded duckbill valve). The second valve 1700 is placed in specific location so that when the closure 1300 is in the open position, shown in FIG. 21, the second valve 1700 is accessible, while, when the closure 1300 is in the closed position, shown in FIGS. 19 and 20, the second valve 1700 is not accessible. The second valve 1700 can be located along the side of the stem portion 1340 below the base section 1330.

As illustrated, the second valve 1700 can be disposed within a side opening 1349 that is formed along the stem portion 1340 and defines an entrance into the main channel 1380. The side opening 1349 is thus a thru hole that forms an entrance into the main channel 1380. The second valve 1700 is mounted within the side opening 1349 so that the side opening 1349 is selectively opened only when it is desired to fill the container 1500 with a liquid. The second valve 1700 is located proximate the interface between the base section 1330 and the stem portion 1340 and in particular, is formed at a location such that when the base portion 1330 and stem portion 1340 are axially moved within the sleeve member 1400 to cause the flange member 1420 of the sleeve member 1400 to seat against the underside of the base portion 1330, the second valve 1700 is closed off by the sleeve member 1400.

Figure 21:
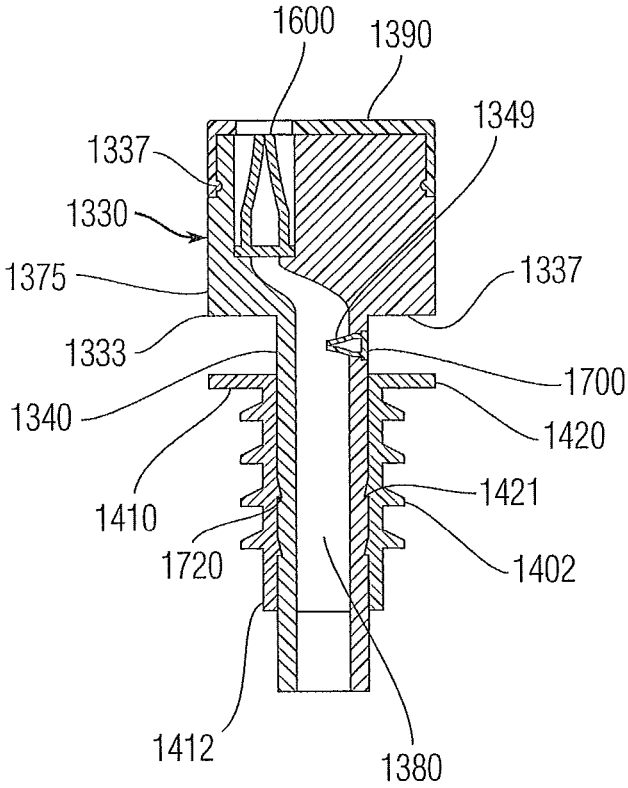
FIG. 21 is a front elevation view of the closure of FIG. 19 in an open position.

FIG. 21 shows an open position where the base portion 1330 and stem portion 1340 are in an open position (load or fill position) and the second valve 1700 and side opening 1349 are accessible in a space between the flange 1420 of the sleeve member 1400 and the underside of the base portion 1330. Since the side opening 1349 is in direct communication with the main channel 1380, it defines a fill port through which fluid can be introduced into the main channel 1380 and into the container 1500.

The closure 1300 includes a coupling member that also serves as tamperproof feature. More specifically, along an inner surface that defines the bore 1421 formed within the sleeve member 1400, one or more first locking members 1720 can be formed. The stem portion 1340 of the closure 1300 includes complementary second locking members 1730. The locking members can be in the form of locking detents as shown. The base section 1330 and stem portion 1340 are free to move axially within the bore 1421 of the sleeve member 1400 within the limits of the locking detents.

Figure 19:
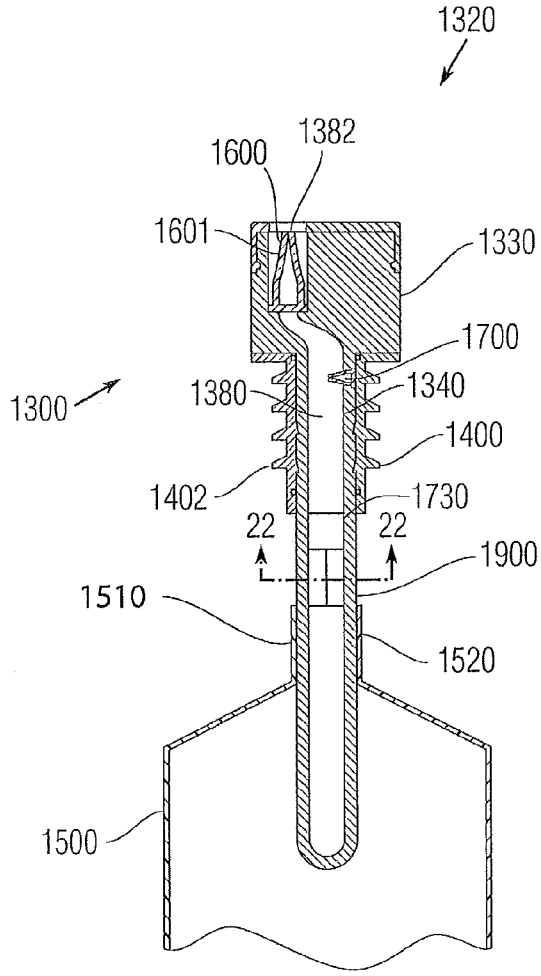
FIG. 19 is a front view of a container closure according to yet another embodiment.

The product is filled with the base section 1330 and stem portion 1340 in the up position of FIG. 21 to provide access to the second valve 1700 and side opening 1349 which functions as a fill port. After filling is completed, the base section 1330 and stem portion 1340 are pushed down and held in place with the detents. This results in the base section 1330 and stem portion 1340 being locked in place by the detent. Once it is locked, it can not be unlocked, thereby creating a tamperproof seal for the fill valve 1700. This locked position is shown in FIGS. 19 and 20 where the fill valve 1700 is not accessible since the sleeve member 1400, which is located radially outward thereto, covers the fill valve 1700.

It will be appreciated that other types of mechanical coupling members can be used for selectively securing (locking) the two parts together to prevent any additional filling of the container 1500.

As previously mentioned, the base section 1330 is integrally attached to the stem portion 1340 and can be formed in situ as a single plastic structure by conventional molding techniques, such as injection molding, etc. The base section 1330 defines a top surface of the closure 1300 and has a sidewall that has an outer surface 1335. When the base section 1330 is cylindrically shaped, the outer surface 1335 is a circumferential surface. The outer surface 1335 can include a retaining feature 1337 for coupling a cap member 1390 to the base section 1330 as described in greater detail below. The retaining feature 1337 can be in the form of a circumferentially shaped charnel or track that not only couples the cap member 1390 to the base section 1330 but also permits the cap member 1390 to be rotatable relative to the base section 1330.

The closure 1300 is intended for use with a liner that holds a liquid intended to be selectively dispensed to the user. Applicants have found that the flow spike construction (e.g., a flattened conical stem portion) allows the liner to more easily and effectively deflate and fit the form, while having enough rigidity to allow the liquid to flow through the side openings (slots).

Figure 22:
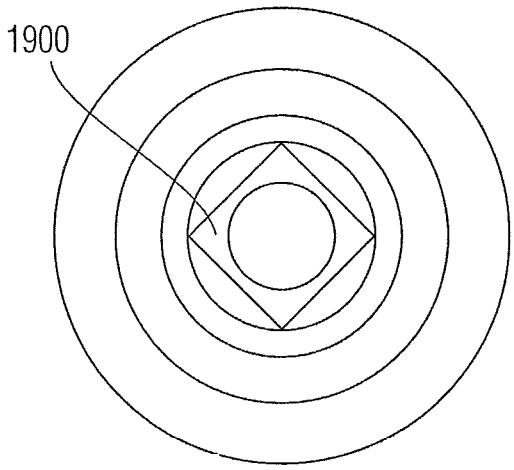
FIG. 22 is a cross-sectional view taken along the line 22-22 of FIG. 19.

FIGS. 19-22 also show another manner in which the liner is retained to the closure 1300. In this embodiment, a heat seal area 1900 is formed along the stem portion 1340 to provide an effective means for securely attaching the liner to the closure 1300. The heat seal area 1900 is an area of the stem portion 1340 that has different structural characteristics compared to the surrounding areas. For example, the heat seal area 1900 can have a square cross-sectional shape as shown in FIG. 22. This allows a liner to be utilized without a stem, thereby reducing the number of interfaces or costly features, such as threads. As mentioned above, the flow spike is formed to allow for free flow of the product and counters and overcomes any self-sealing of the liner due to removal of the stem of the liner. A square collar (heat seal area 1900) that meshes with the top of a flat seal bag (liner) creates a quality fit. The shape also allows for the flat bag (liner) to transition nicely to the closure 1300 and allows the bag (liner) to be easily heat sealed. The liner is thus heat sealed in the heat seal area 1900.

Figure 23:
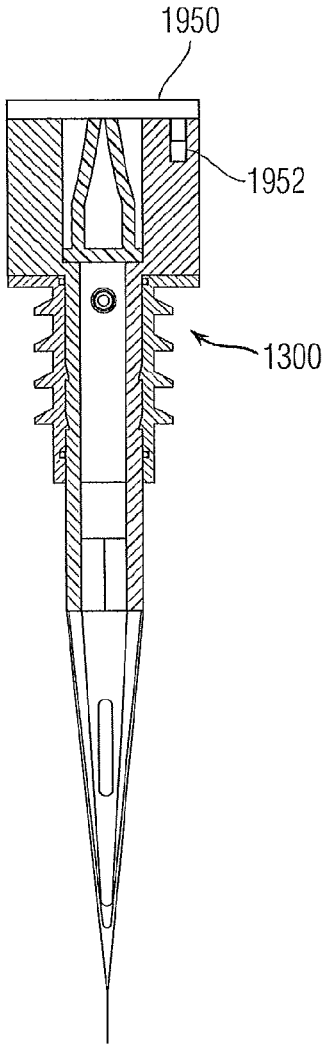
FIG. 23 is a side elevation view of the closure of FIG. 19 with a swing cap.
Figure 24:
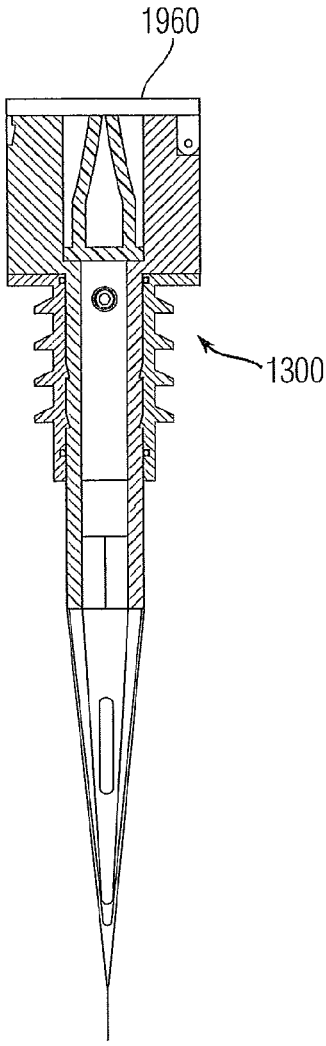
FIG. 24 is a side elevation view of the closure of FIG. 19 with a flip cap.
Figure 25:
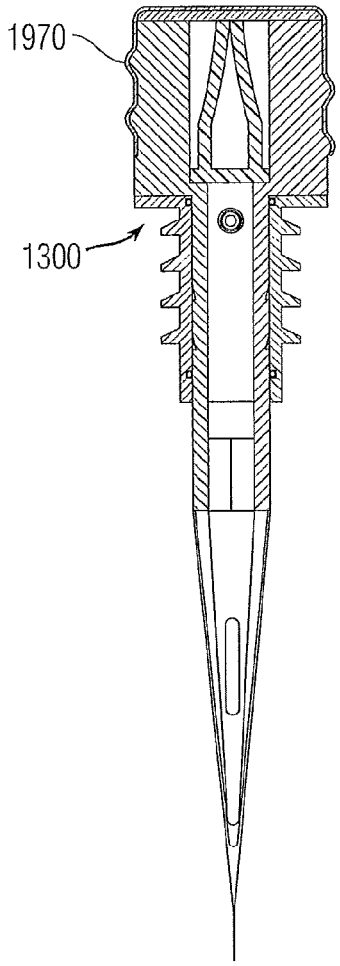
FIG. 25 is a side elevation view of the closure of FIG. 19 with a screw cap.

FIGS. 23-25 illustrate different cap configurations for use with the closure 1300. FIG. 23 shows a swing cap 1950 being attached to the base section 1330. The swing cap 1950 is pivotally attached to the base section 1330 at a pivot point 1952. FIG. 24 shows a flip cap 1960 being used and coupled to the base section 1330 of the closure 1300. FIG. 25 shows a screw cap 1970 that threadingly mates with complementary outer threads formed on the base section 1330.

Figure 26:
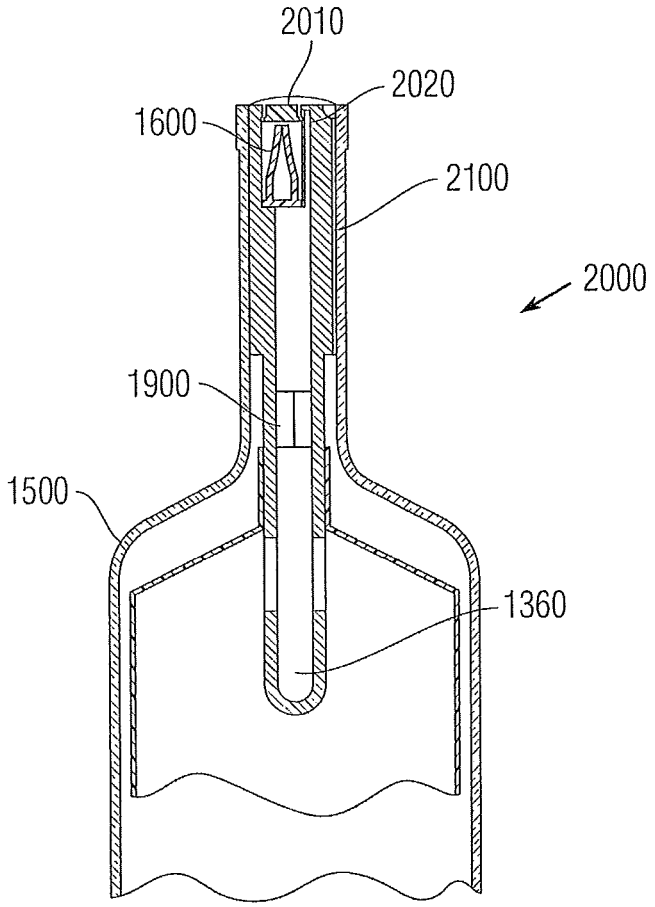
FIG. 26 is a front elevation view of the closure showing a vent channel or groove.

FIG. 26 shows another closure 2000 according to another embodiment. The closure 2000 is similar to the closure 1300 and therefore like elements are numbered alike; however, in this embodiment, the parts of the closure 1300 are essentially molded in one piece. The first valve 1600 (duckbill valve) can either be molded in place or be a retained separate piece in the event that the valve needs to be changed for different viscosities of stored liquid. The cap cover 2010 is also integrated and held in the closed position by the side of the valve wall as show in the figure. In other words, the cap has a protrusion (boss) or the like that can be formed and disposed within the main channel 1380 in which the first valve 1600 is located. In other versions, it can be required that upon opening, the cover is torn back creating a tamperproof closure. Since the cap 2010 is formed of a pliable material, a septum 2020 is integrated into the cap 2010 and has a dimple located on the top for easy location of the fill port. A vent channel or groove 2100 runs down the side of the cap allowing for pressure equalization between the outside of the bag (liner), the inner part of the bottle and the outside during dispensing.

Figure 27:
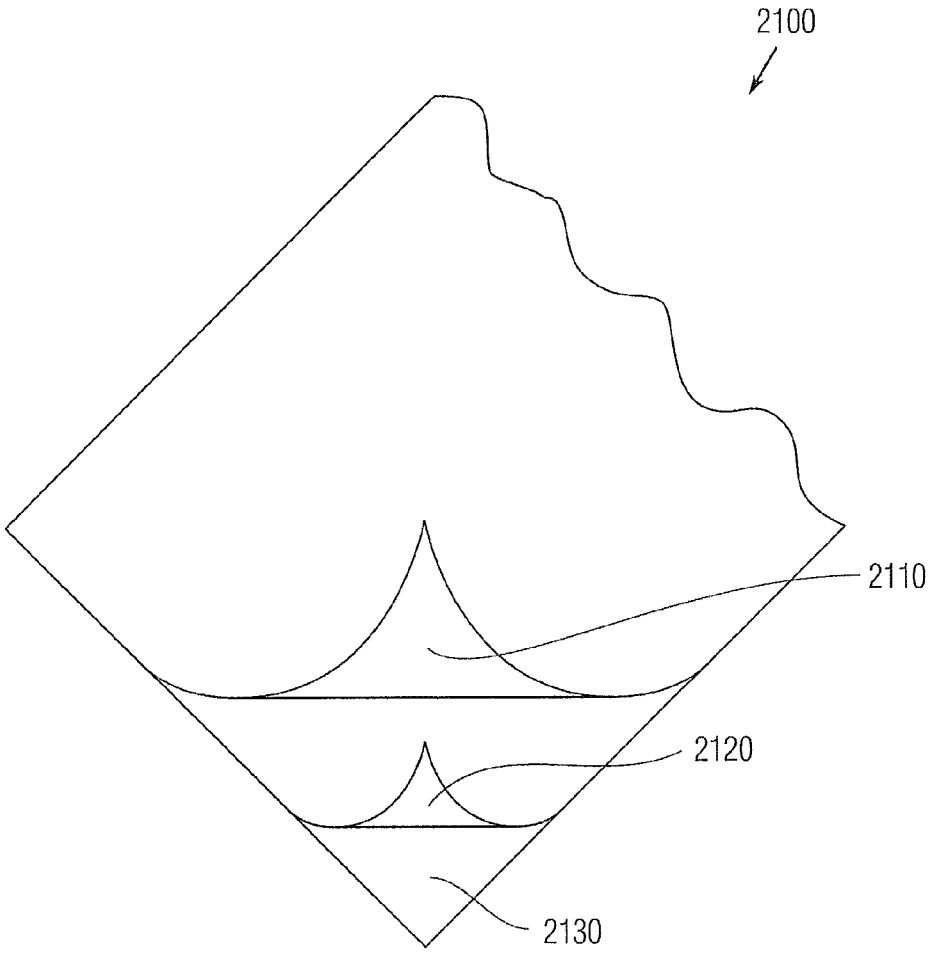
FIG. 27 is a partial perspective view of a bag lamination structure.

FIG. 27 shows a sample construction for an exemplary bag (liner) 2100. The bag 2100 is a laminated structure. The bag 2100 is formed of a first layer 2110 that represents the outermost layer and is an oxygen scavaging film. The next layer 2120 is a PET. Mylar layer that adds another layer of barrier material and can also prevent light infiltration. The final layer 2130, which is in contact with the product, is a food grade polyethylene layer.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A closure for a container for sealing the contents of the container comprising:

a cap assembly having a first portion that is insertable into a dispensing opening formed in the container and a second portion that is rotatable relative to the first portion and positionable between at least a dispensing position in which the contents of the container can be dispensed through the cap assembly and a closed position in which the contents are sealed in the container from atmospheric conditions, and a rollable, flexible liner for receiving and holding the contents, the liner being fixedly attached to the cap assembly at an interface and in fluid communication therewith so that the liner can initially receive the contents through the cap assembly and later dispense the contents through the cap assembly, wherein the liner can be rolled up to allow the liner to expand and unroll itself into an inside of the container when the contents are delivered to the liner, the interface between the liner and the cap assembly being located between and spaced from an inner surface of the container, thereby permitting removal of the combined cap assembly and liner in an attached state from the inside of the container;

wherein the first portion includes a base section and a stem extending outwardly therefrom for reception into the container opening, the stem and base section including at least a vent channel for delivering air into the container but outside of the liner and a main channel that is in fluid communication with the interior of the liner and the second portion is a cap that is rotatably coupled to the base section.

2. The closure of claim 1, wherein the base section includes a dispensing channel that is in fluid communication with the main channel and a separate fill channel that is in fluid communication with the main channel and a valve assembly that is operatively connected to the dispensing channel and includes a one way valve that opens only in a direction that permits the contents of the liner to flow through the main channel and dispensing channel and out of the cap assembly.

3. The closure of claim 2, wherein the fill channel includes a second valve member in the form of a pierceable membrane.

4. The closure of claim 2, wherein the valve assembly includes a valve seat and valve member that is coupled thereto and movable to an open position that permits the contents to flow through the valve seat and out of the cap assembly, wherein an outer peripheral edge of the valve member sits on a ledge formed in the base section surrounding the dispensing channel when the valve member is in a closed position.

5. The closure of claim 4, wherein a body of the valve seat is frictionally held within the dispensing channel and the ledge extends radially outward from the dispensing channel with the valve member sitting on the ledge in the closed position.

6. The closure of claim 1, wherein the flexible liner is integrally attached to the cap assembly by means of a heat weld.

7. The closure of claim 1, wherein the flexible liner is integrally attached to the cap assembly in situ in a common mold.

8. The closure of claim 1, wherein the liner has an ellipsoid or prolate spheroid shape that is designed not to fold on top of itself and become obstructed as the contents contained therein are dispensed therefrom.

9. A closure for a container for sealing the contents of the container comprising:

a cap assembly having a first portion that is insertable into a dispensing opening formed in the container and a second portion that is rotatable relative to the first portion and positionable between at least a dispensing position in which the contents of the container can be dispensed through the cap assembly and a closed position in which the contents are sealed in the container from atmospheric conditions, and a rollable, flexible liner for receiving and holding the contents, the liner being fixedly attached to the cap assembly at an interface and in fluid communication therewith so that the liner can initially receive the contents through the cap assembly and later dispense the contents through the cap assembly, wherein the liner can be rolled up to allow the liner to expand and unroll itself into an inside of the container when the contents are delivered to the liner, the interface between the liner and the cap assembly being located between and spaced from an inner surface of the container, thereby permitting removal of the combined cap assembly and liner in an attached state from the inside of the container; wherein the cap assembly has a first interlocking structure and an open end of the liner includes a second interlocking structure that is complementary to the first interlocking structure such that when the first and second interlocking structures mate together, the liner is securely, sealing, yet detachably coupled to the cap assembly:

wherein the first interlocking structure is a female snap-fitting member and the second interlocking structure is a male snap-fitting member;

wherein the first interlocking structure is a plurality of annular grooves formed along an inner surface of a main channel that is formed in the first portion of the cap assembly and is in fluid communication with a dispensing channel that is formed in the first portion, and the second interlocking structure is a plurality of ring members that are configured to snap-fittingly engage the annular grooves so as to securely couple the liner to the cap assembly.

10. The closure of claim 2, wherein the fill channel is sealed by a pierceable membrane, the fill channel being in fluid communication with the main channel of the stem, in a fill position of the cap, to permit filling of the liner when a third opening in the cap is in registration with the fill channel, the second opening being in registration with the vent channel in the fill position of the cap.

11. The closure of claim 1, wherein the container is selected from the group consisting of a glass bottle, a plastic bottle, a carton, a cask, and a barrel.

12. A closure that seals an inside of a container from atmospheric conditions comprising:

a first part having a main body portion and a stem portion extending therefrom for insertion into a dispensing opening formed in the container, the first part including a first main channel in communication with the inside of the container, the first part having a dispensing channel and a separate fill channel formed therein each of which is in communication with the first main channel, the main body portion including a first one-way valve member disposed in the dispensing channel for sealing the inside of the container when the first one-way valve member is in a closed position and a seal member that seals the fill channel; and a second part in the form of a cap member that is rotatably coupled to the main body portion of the first part, the cap member having a first opening formed therein, the cap member being positionable between a first position, in which the first one-way valve member that underlies the cap member is exposed through the opening in the cap member, and second and third positions in which the first opening is offset from the first one-way valve member and the dispensing channel, thereby preventing fluid from being dispensed;

a liner which stores a liquid within the inside of the container, the liner being contained inside the container and being securely attached to the first part by at least partial insertion into the first main channel such that an inside of the liner is freely in fluid communication with the first main channel and is also in communication with the dispensing channel to permit dispensing of the liquid stored within the liner, the inside of the liner being further in communication with the fill channel to permit filling of the liner with the liquid, wherein the liner can be rolled up to allow the liner to expand and unroll itself within the inside of the container when the liquid is delivered to the liner;

wherein the second part includes a second opening that is in registration with the fill channel in only the second position to permit the liquid to be delivered through the fill channel to the liner for filling thereof;

wherein the first part includes a vent channel formed therein and the cap member includes a vent opening, wherein in the first and second positions, the vent channel and the vent opening are in registration with one another, the vent channel being open to the inside of the container but is not in communication with the liquid stored in the container so as to prevent the liquid from flowing through and out of the first and second parts, wherein in the third position, the fill channel, the dispensing channel and the vent channel are sealed off by the second part.

13. The closure of claim 12, wherein the cap is snap-fittingly mated to the main body portion of the first part.

14. The closure of claim 12, wherein the liner is mechanically attached the first seal member.

15. The closure of claim 12, wherein the liner is integrally formed with the first seal member in situ in a common mold.

16. The closure of claim 12, wherein the vent channel is separated from the dispensing channel and the first main channel and the seal member covering the fill channel is a pierceable septum.

17. The closure of claim 12, wherein the liner is formed of a flexible plastic material and is integrally attached to the stem portion of the first part within an opening formed therein that is in fluid communication with the dispensing channel.

18. The closure of claim 12, wherein the stem portion has a flexible prong extending outwardly from an outer surface thereof for engaging an inner surface of the container when the stem portion is inserted through the dispensing opening of the container, the flexible prong flexing outwardly to an engaged position once the stem portion and prong clear the opening of the container so as to securely and sealingly couple the stem portion to the container.

19. The closure of claim 12, wherein the cap member is securely yet rotatably coupled to the main body portion of the first part in a manner in which the cap member is not freely detachable from the main body portion.

20. The closure of claim 12, wherein the cap member is snap-fittingly mated to the main body portion and in the second and third positions, the cap overlies the one-way valve.

21. The closure of claim 12, wherein the vent channel is separated from the liner by a wall.

* * * * *